US006990907B1

(12) United States Patent
Samarin

(10) Patent No.: US 6,990,907 B1
(45) Date of Patent: Jan. 31, 2006

(54) METHOD AND SYSTEM FOR WEIGHTING MODEL RAILROAD CARS

(76) Inventor: Howard Samarin, 482 8th Ave. NW., Dyersville, IA (US) 52040

( * ) Notice: Subject to any disclaimer, the term of this patent is extended or adjusted under 35 U.S.C. 154(b) by 0 days.

(21) Appl. No.: 10/709,226

(22) Filed: Apr. 22, 2004

(51) Int. Cl.
*A63H 17/00* (2006.01)

(52) U.S. Cl. ..... 105/1.5; 446/467; 105/238.2

(58) Field of Classification Search ..... 105/1.5, 105/238.2, 157.2; 446/467
See application file for complete search history.

(56) References Cited

U.S. PATENT DOCUMENTS

| | | | |
|---|---|---|---|
| 3,628,281 | A | 12/1971 | Whitman |
| 4,386,777 | A | 6/1983 | Prehodka |
| 4,568,300 | A | 2/1986 | Rasmussen et al. |
| 5,427,561 | A | 6/1995 | Eichhorn et al. |
| 6,074,271 | A | 6/2000 | Derrah |

OTHER PUBLICATIONS

"Optimum Model Train Weight" Micro-Mark, The Small Tool Specialists, derived from NMRA recommended practice—Jan. 1990.*

Weighting Supplies, www.ppw-aline.com/weights.htm.*

"Building a La Belle Pacific Coast HOn3 Wood Boxcar Kit", pp. 1-30m www.polyweb.com/dans_rr/Boxcar/, Mar. 1996.*

"mondotrains", community forum, www.trains.com/community/forum/topic.asp?page=1&TOPIC_ID=18587, Jul. 2004.*

"Making a unique depressed centre flat car in HO", The Interchange—Ottawa Valley Associated Railroaders—pp. 1-7, Issue 370, Jan. 2003.*

The Keystone Modler, p. 12, Dec. 2004.*

"Do it Yourself in Z-scale", www.zscale.org/articles/traction.html, pp. 1-7 (no date).*

Jay M. Potter, "The First 'Heavy' SD70MACS", Diesel Era, Sep./Oct. 2003.

Jeff Wilson, "Back to Basics Car Weighting", Model Railroader, Feb. 2003, pp. 56, 58.

* cited by examiner

*Primary Examiner*—Mark T. Le
(74) *Attorney, Agent, or Firm*—Simmons, Perrine, Albright & Ellwood, PLC

(57) ABSTRACT

A system and method for weighting a model railcar which uses a plurality of thin machined led alloy weights disposed in recesses of a model rail car frame.

8 Claims, 2 Drawing Sheets

METHOD AND SYSTEM FOR WEIGHTING MODEL RAILROAD CARS

BACKGROUND OF INVENTION

For years, the model railroad enthusiasts have endeavored to replicate as much of the appearance and performance of full-sized railcars into model railcars. They have included many minute details of the appearance of the railcar in their corresponding model.

However, numerous differences exist between model railcars and their full-sized counterparts beyond the mere difference in size. Model railcars are often made of material which is relatively inexpensive and easy to use for creating a scale model. Plastic materials are often used because of these benefits and more. While these plastic model railcars have many beneficial aspects, they do suffer from at least one significant problem. The weight ratio of a model railcar to a full-sized railcar is usually not proportional to the sizes of the same cars. This lighter weight model design creates one serious disadvantage—the ability for the model railcar to track correctly, especially at high speeds around curves, and when coupling and decoupling, etc.

Numerous attempts have been made to add weights to these cars. One example would be to add weight to the inside of the cargo area of the railcar. Other attempts have been to place the weights underneath the cars. Many of these weights are cast in a mold to a regular shape.

While such model railcar weighting techniques have been used in the past, they do have some drawbacks. One of the most significant drawbacks of many of these techniques is the poor aesthetics or poor realism. When a real train moves down a track, a certain percentage of the boxcar doors may be open; so hiding weights in the cargo area of model boxcars is not totally true to the model railroader's desire for realism. Having the weights visible in any way is clearly undesirable. Cast lead weights are often too thick to be easily concealed on a model railcar.

Consequently, there exists a need for improved methods and systems for weighting model railcars in an aesthetically pleasing manner.

SUMMARY OF INVENTION

It is an object of the present invention to provide a system and method for weighting a model railcar in an aesthetically pleasing manner.

It is a feature of the present invention to utilize a machined thin lead weight.

It is another feature of the present invention to design an array of weights which are concealed in predetermined recesses or other non-conspicuous locations on or in a model railcar.

It is an advantage of the present invention to achieve improved weight distribution realism (improved realism with respect to center of gravity) and bring the model railcar close to or above National Model Railroad Association (NMRA) weight recommendations.

The present invention is an apparatus and method for weighting model railcars designed to satisfy the aforementioned needs, provide the previously stated objects, include the above-listed features, and achieve the already articulated advantages. The present invention is carried out in a "non-conspicuous" manner in a sense that the visible weights often associated with creating a realistic weight distribution emulation have been greatly reduced.

Accordingly, the present invention is a system and method including a plurality of machined thin lead alloy weights which are custom made to fit predetermined voids, recesses or other non-conspicuous areas in a model railcar.

BRIEF DESCRIPTION OF DRAWINGS

The invention may be more fully understood by reading the following description of the preferred embodiments of the invention in conjunction with the appended drawings wherein.

DETAILED DESCRIPTION

Figure 1:
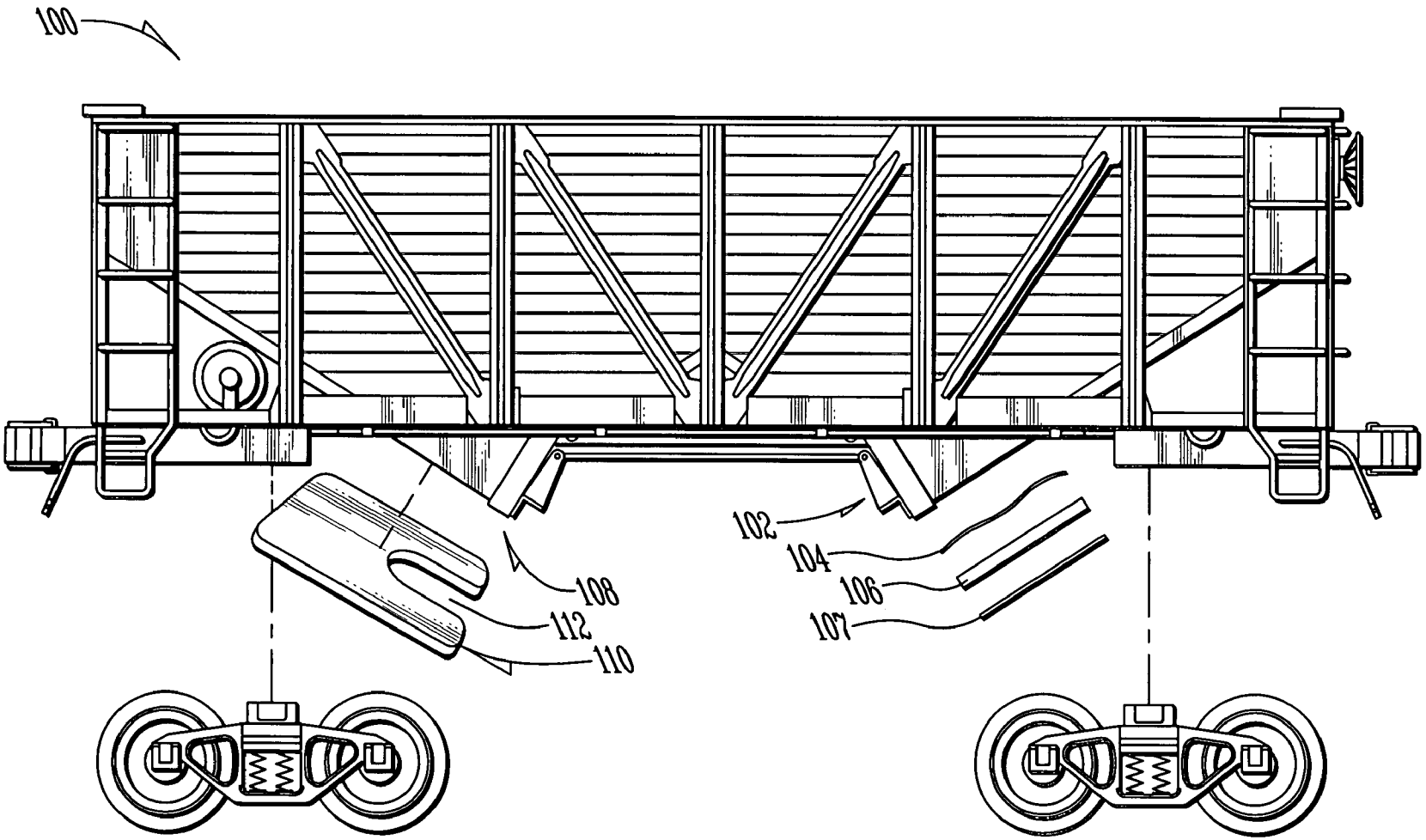
FIG. 1 is an exploded view of a model hopper-type railcar having the thin machined weights of the present invention.

Now referring to the drawings wherein like numerals refer to like matter throughout, and more specifically referring to FIG. 1, there is shown an exploded view of a hopper-type model railcar, generally designated 100, which has hopper section 102 disposed lower than a main frame level of the car 100. Also shown is a first custom-machined thin lead alloy weight 106, which is coupled via adhesive 104 to the hopper section 102. Also shown is an identical thin weight 110 on a second hopper section 108 which reveals a custom cutout portion 112 which is in registration with a predetermined feature on the hopper section 108. Thin weight 110 is a non-toxic lead alloy which is machined to fill in minor voids in the model railcar. The thickness of this weight depends upon particular details of the model railcar, but they typically will be between 0.01388 inches to 0.25 inches. A layer of adhesive is disposed on the hopper section 108 between the weight and the railcar underside. Also a thin coat of paint 107 is shown disposed over the thin weight 106.

Figure 2:
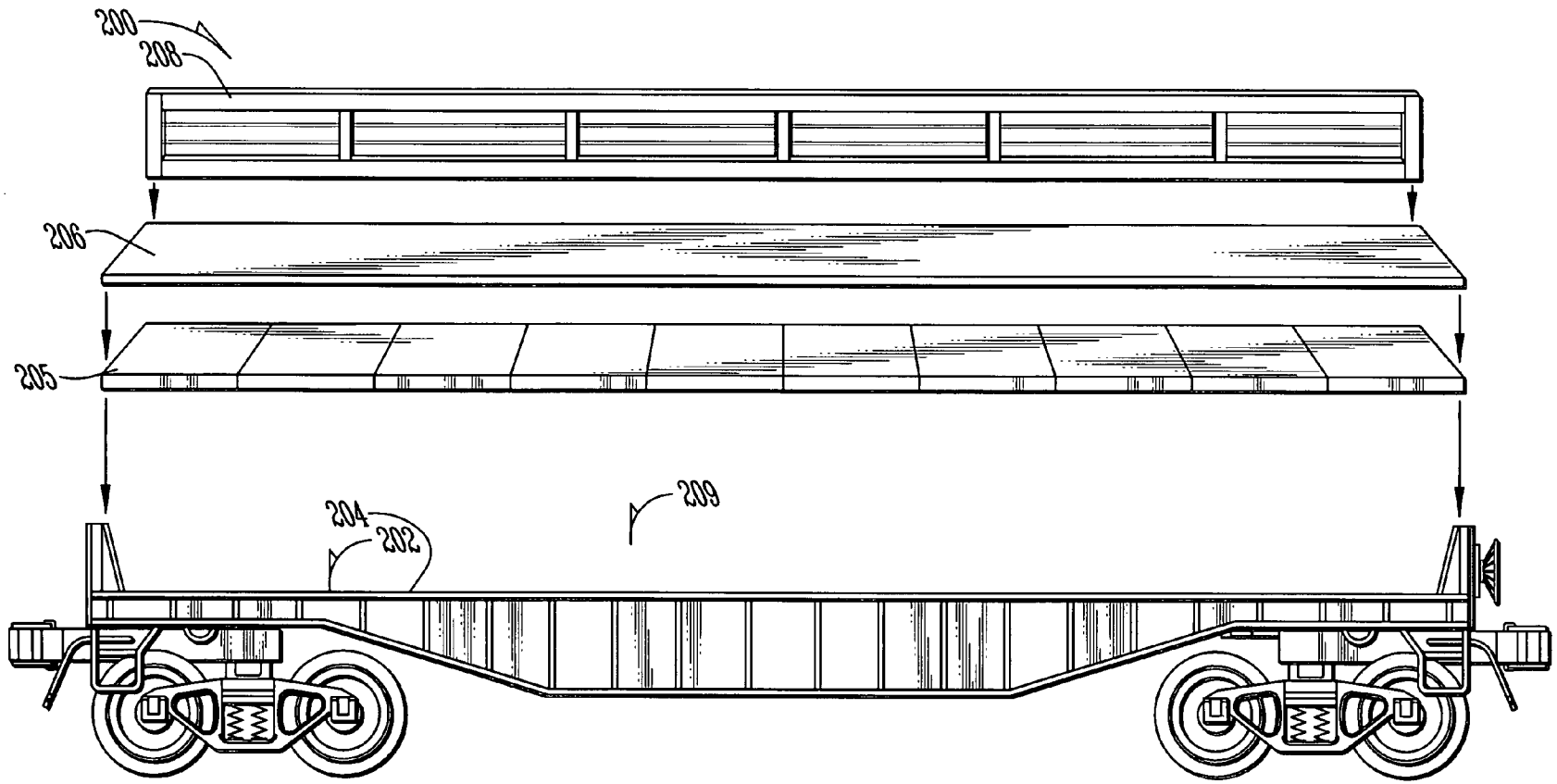
FIG. 2 is an exploded view of a model flatbed-type railcar having the machined thin lead alloy weights of the present invention.

Now referring to FIG. 2, there is shown a view of a flatbed-type model railcar, generally designated 200, having a frame section 202 atop of frame section 204 with a plurality of recesses 209 therein. A plurality of machined thin lead alloy weights 205 are shown disposed in the recesses and under the flooring 206. The side wall detail of the railcar is shown as 208. Machined thin lead alloy weights 205 can vary in thickness from 0.001388 to 0.0833 inches. Of course, different types of model railcars which do not apply weights under the flooring could use thicker weights.

In operation, the thin lead alloy weights of the present invention may be made in the following process:

1. First, a commercially available model railcar is obtained.
2. The model railcar is assessed to determine if additional weight is desirable.
3. The model railcar is examined to determine locations thereon where thin machined lead alloy weights might be attached in a non-conspicuous manner.
4. A plurality of thin weight blanks are machined into thin weights to fit in the predetermined positions on said model railcar.
5. The thin weights are affixed to the model railcar via an adhesive.

The lead alloy used in the present invention can be any type of lead alloy; however, it is believed that optimal results are achieved when the lead alloy is a lead/tin/antimony alloy. In an exemplary embodiment of the present invention, a lead alloy of 78% to 85% Pb, and 3% to 13% Sn, and 9%–12% Sb are used. A preferred alloy of approximately 84% Pb, 4.5% Sn and 11.5% Sb, or 79.5% Pb, 11% Sn, and 9% Sb, may be used.

In an exemplary method of the present invention, the lead alloy is obtained in thin sheets of 0.027 inch to 0.25 inch thickness. These sheets or blanks are cast using various techniques, including but not limited to an Elrod machine. These sheets or blanks are then cut with a rotary-type saw, such as Glider TrimOsaw manufactured by Hammond Machinery Builders of Kalamazoo, Mich. Special carbide-tipped blades may be used, such as the carbide-tipped printer's thin saw blade which may be exclusively made by the Gay-Lee Company of Clawson, Mich.

The process of machining or cutting lead alloys may have some drawbacks. These drawbacks are overcome by the following process:

When the above-described saw is used for machining, the waste from machining is a curved or shaved chip and not dust, powder or minute particles. These chips can be used as untreated feed stock for an Elrod casting machine. It is preferred to outfit the saw with internal deflectors and external covers so as to minimize chips from flying away from the cutting point. The sawing is done dry and because of the size of the chips made, very little cross ventilation is required.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A model railcar comprising:

a frame having a plurality of recesses therein; and a car flooring disposed on top of the frame said frame having a plurality of model railcar wheels attached thereto;

a plurality of custom-machined lead alloy weights disposed in said plurality of recesses, and disposed between said frame and said flooring so that said plurality of custom-machined lead alloy weights are concealed from sight when viewed from an elevation view; and wherein each of said plurality of custom-machined lead alloy weights has a thickness dimension less than 0.26 inches.

2. A model railcar of claim 1 comprising a gondola railcar.

3. A model railcar of claim 2 wherein said plurality of custom-machined lead alloy weights are disposed beneath said flooring of said gondola railcar.

4. A model railcar of claim 1 wherein said plurality of custom-machined lead alloy weights are comprised of an alloy of between 80% to 84% lead by weight.

5. A model railcar of claim 4 wherein said alloy comprises between 4%–12% tin.

6. A model railcar of claim 5 wherein said plurality of custom-machined lead alloy weights are generally planar and have a thickness in a range of 0.01388 inches to 0.25 inches.

7. A model railcar of claim 6 wherein said alloy comprises between 9%–12% antimony.

8. A model railcar of claim 7 wherein said alloy comprises approximately 9% antimony.

* * * * *